US005927577A

United States Patent [19]

Braun

[11] Patent Number: 5,927,577

[45] Date of Patent: Jul. 27, 1999

[54] FOLDOVER BUCKLE EXTENDER

[75] Inventor: Rafael Braun, Flushing, N.Y.

[73] Assignee: E. Gluck Corporation, Long Island City, N.Y.

[21] Appl. No.: 08/857,353

[22] Filed: May 16, 1997

[51] Int. Cl.[6] ..... A44C 5/18

[52] U.S. Cl. ..... 224/176; 224/164; 24/71 J

[58] Field of Search ..... 24/71 J, 70 J, 24/68 J, 69 J; 63/3.2; 224/164, 176

[56] References Cited

U.S. PATENT DOCUMENTS

| | | | |
|---|---|---|---|
| 1,700,489 | 1/1929 | Dalo | 24/71 J |
| 1,892,060 | 12/1932 | Kestenman . | |
| 1,985,835 | 12/1934 | Prestinari | 24/71 J |
| 2,007,537 | 7/1935 | Kraemer . | |
| 2,444,360 | 6/1948 | Mauch . | |
| 2,499,102 | 2/1950 | Levine . | |
| 3,665,564 | 5/1972 | Oka . | |
| 4,000,542 | 1/1977 | Omichi . | |
| 4,542,561 | 9/1985 | Hysek . | |
| 4,545,094 | 10/1985 | Fontana . | |

*Primary Examiner*—Linda J. Sholl

*Attorney, Agent, or Firm*—Gottlieb, Rackman & Reisman, P.C.

[57] ABSTRACT

An improved extender device for adjusting the length of a watch or bracelet band is provided. The extender element of the invention comprises a body having a width no greater than the distance measured between the sidewalls of the main watch link and shell, a coupling member formed at one end of the body and having a width substantially equal to the width of the shell, and at least one guide element formed at the other end of the body for accommodating a spring-loaded pushpin. The pin is received between the corresponding sidewall openings of the shell as the shell overlies and otherwise receives the body of the extender element.

12 Claims, 4 Drawing Sheets

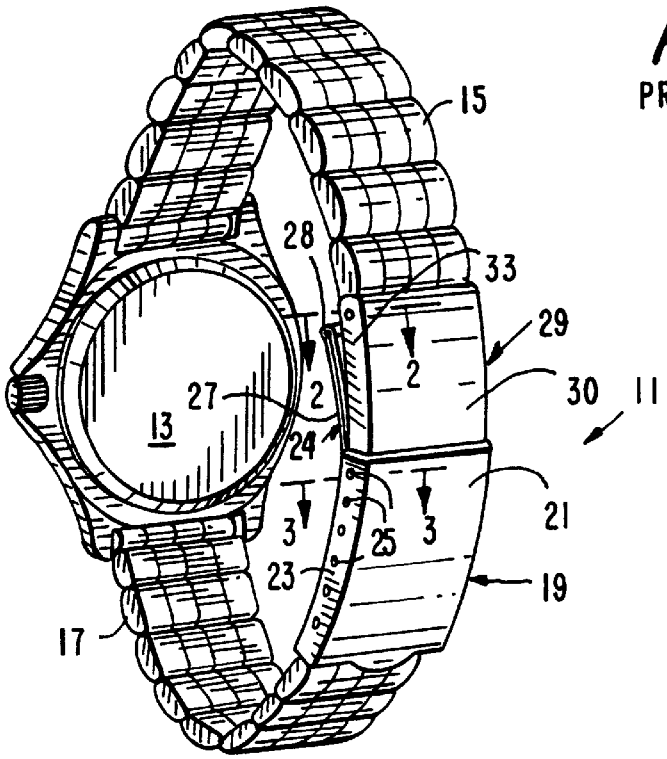
FIG. 1
PRIOR ART
FIG. 2
PRIOR ART
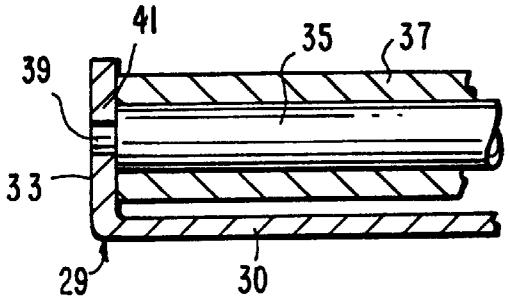
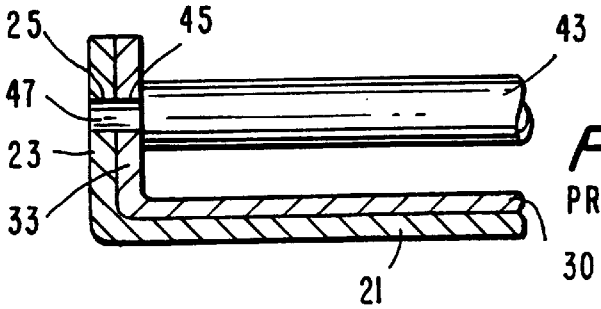
FIG. 3
PRIOR ART

FOLDOVER BUCKLE EXTENDER

BACKGROUND OF THE INVENTION

This invention relates to an extender element for watchbands and bracelets, and more particularly to an extender element in which the band of a watch bracelet need not be modified in design.

The lengthening or shortening of metal watchbands is a relatively complex problem and requires the adding or subtracting of links to the watchband. Particularly, the removal or addition of individual links may require special tools and is a relatively complex operation.

In prior designs for watchbands and bracelets with foldable or foldover buckles, a length extender can be used and is added to the bracelet or band in order to facilitate length adjustment. However, most of the prior art buckle extender designs are less than satisfactory.

In the first place, the pin which connects the extender to the original band shell of the buckle has to be specially designed in order to penetrate two vertical sidewalls. In particular, the pin must go through both the sidewalls of the buckle shell and the sidewalls of the extender element.

In addition, because the opening of the extender is designed to be smaller than the opening of the original buckle shell, one of the band elements for a watch or bracelet must be reduced in size in order to accommodate this opening. In other words, the watch or bracelet band needs to have two different widths, one where it is coupled to the original buckle shell, and the other where it is coupled to the extender element.

Moreover, the typical length extender for a watch or bracelet has vertical sides with very sharp edges—if not careful, the wearer can be injured when slipping the watch or bracelet over his or her wrist.

Accordingly, it would be desirable to provide an improved buckle extender to overcome the above disadvantages.

SUMMARY OF THE INVENTION

Generally speaking, in accordance with the invention, an improved extender device for adjusting the length of a watch or bracelet band is provided. The extender element of the invention comprises a body having a width no greater than the distance measured between the sidewalls of the main watch link and shell, a coupling member formed at one end of the body and having a width substantially equal to the width of the shell, and at least one guide element formed at the other end of the body for accommodating a spring-loaded pushpin. The pin is received between the corresponding sidewall openings of the shell as the shell overlies and otherwise receives the body of the extender element.

As will be appreciated, the width of the coupling member formed at one end of the body is substantially the same as the width of the shell itself. Consequently, none of the band elements of the watch or bracelet need to be modified in size. Additionally, since the body of the extender has the same width as that of the inside opening of the buckle shell, it can be easily received therewithin during assembly.

Perhaps most importantly, the extender element of the invention, when the body thereof is received by the watch or bracelet shell, utilizes a standard sized pushpin. The pushpin which is used with the inventive extender need only penetrate the sidewalls of the buckle shell. This is because the body of the extender element that is received within the shell is not formed with any sidewall. Instead, it merely includes some type of underlying guide element through which the pin passes when received at either end thereof by corresponding holes formed in the shell sidewalls.

In the preferred embodiment, the guide elements of the inventive extender element comprise cut-outs formed in a pair of legs depending beneath the body of the inventive extender element. In assembly, the cut-outs are aligned with a selected pair of corresponding holes formed in the shell sidewalls such that the pushpin can be received therethrough and retained at its ends within the corresponding sidewall holes.

If band length is still not appropriate, the guides of the extender element may be aligned with a different pair of corresponding holes formed in the sidewalls of the shell for accommodating the pushpin at different lateral locations along the shell of the band.

Another advantage of the invention is the fact that the inventive extender design eliminates the use of vertical sidewalls. Not only does this feature enable the use of band elements of the same size or width, as well as a standard sized pushpin, it also substantially eliminates the risk of injury from the sharp edges of conventional extender sidewalls.

Accordingly, it is an object of the invention to provide an improved extender element for adjusting the length of a watch or bracelet band.

Still another object of the invention is to provide an improved extender element in which the band of the watch or bracelet need not be modified in size.

Yet a further object of the invention is to provide an improved extender element which uses a standard sized pushpin.

Still another object of the invention is to provide an improved extender element which is made from a flat metal piece rather than having a potentially injurious sharp-edged configuration.

Another object of the invention is to provide an improved extender element which uses existing parts.

Still other objects and advantages of the invention will in part be obvious and will in part be apparent from the following description.

The invention accordingly comprises a product possessing the features, properties and relation of components and parts which will be exemplified in the product hereinafter described, and the scope of the invention will be indicated in the claims found at the end hereof.

BRIEF DESCRIPTION OF THE DRAWINGS

For a fuller understanding of the invention, reference is made to the following description, taken in connection with the accompanying drawings, in which:

FIG. 1 is a perspective view of a watch assembly utilizing an extender element of the prior art;

FIG. 2 is a cross-sectional view taken along line 2—2 of FIG. 1;

FIG. 3 is a cross-sectional view taken along line 3—3 of FIG. 1;

DETAILED DESCRIPTION OF THE PREFERRED EMBODIMENT

Figure 4:
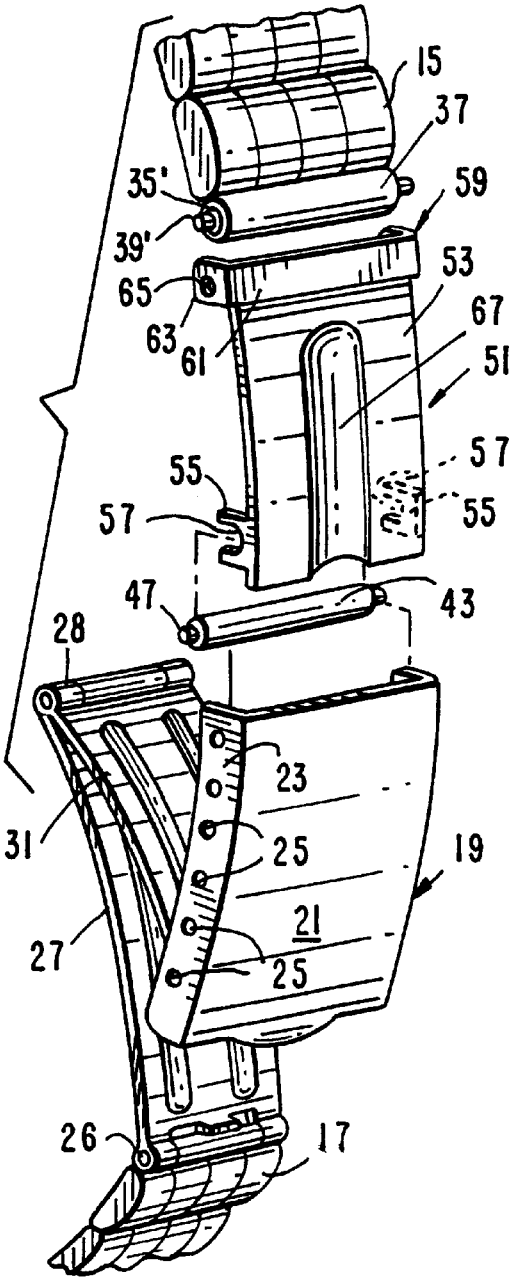
FIG. 4 is an exploded perspective view of the bracelet assembly for a watch which utilizes one version of the extender element of the invention.

Referring first to FIGS. 1–3, a watch assembly 11 made in accordance with the prior art is illustrated. Watch assembly 11 comprises a case 13 from which watchbands 15 and 17 depend. Watchband 17 includes a plurality of link members and is coupled to a shell 19 by means of a pivotally connected two-element closure, as is well known. The closure 24 consists of a first foldable element 27 foldable over another foldable element 31 and pivotally connected to element 27 by means of a pivot connection 28 (see FIG. 4). Foldable element 27 is connected to watchband 17 by means of a second pivot connection 26.

Shell 19 is connected to the end of watchband 15, which also consists of a plurality of link members, by means of an extender element 29 as shown. Shell 19 comprises a top member 21 and sidewalls 23 extending the full length of the top of shell 19. Sidewalls 23 are provided with opposed corresponding pairs of holes or openings 25 for selectively receiving a spring-loaded pin 43 (see FIG. 3) therebetween in order to connect the end of extender element 29 to shell 19, as described later on.

Extender element 29, in accordance with the prior art, is constructed somewhat similarly to shell 19 and comprises a top 30 and a pair of sidewalls 33, as shown. As best depicted in FIG. 2, sidewalls 33 of extender element 29 are formed with corresponding plural pairs of holes 41 for receiving a spring-loaded pin 35 therein. Pin 35 includes a pair of retractable spring tip elements 39 for selective reception within holes 41 formed within sidewalls 33 of extender 29. Band 15, which is coupled to extender element 29, is formed at its end thereof with a tube-shaped tongue 37 which wraps about pin 35, as best depicted in FIG. 2. In order to uncouple band 15 from extender 29, pin elements 39 are retracted inwardly, thereby freeing tube-shaped tongue 37 from engagement with extender 29.

Referring now to FIG. 3, the other end of extender element 29 is selectively coupled within shell 19 by means of spring pin 43. Pin 43 includes a pair of retractable pin tip elements 47 of a length substantially greater than that of pin elements 39 of spring pin 35 (see FIG. 2). Pin elements 47 are designed to penetrate through both corresponding holes 45 formed in sidewalls 33 of extender element 29 as well as corresponding holes 25 formed in sidewalls 23 of shell 19. As is well known in the art, in order to adjust the length of the band of watch assembly 11, extender element 29 is selectively inserted within shell 19 to a desired distance such that holes 45 of extender sidewalls 33 are aligned with one pair of corresponding holes 25 formed in sidewalls 23 of shell 19.

In order for shell 19 to accommodate therewithin extender element 29, the width of extender element 29 is smaller than that of shell 19. Therefore, the end of watchband 15 must have a width somewhat less than that of the end of watchband 17 in order for the overall band assembly to fit the two ends of the shell and extender respectively. In addition, pin 43 is different in size and design from pin 35 and must have retractable pin elements 47 sized to be received in both the sidewalls 33 and 23 of extender element 29 and shell 19 respectively (see FIG. 3). In other words, a uniform sized pin cannot be used for both coupling the end of band 15 to extender element 29 (see FIG. 2), as well as for coupling extender element 29 to shell 19 (FIG. 3).

Figure 5:
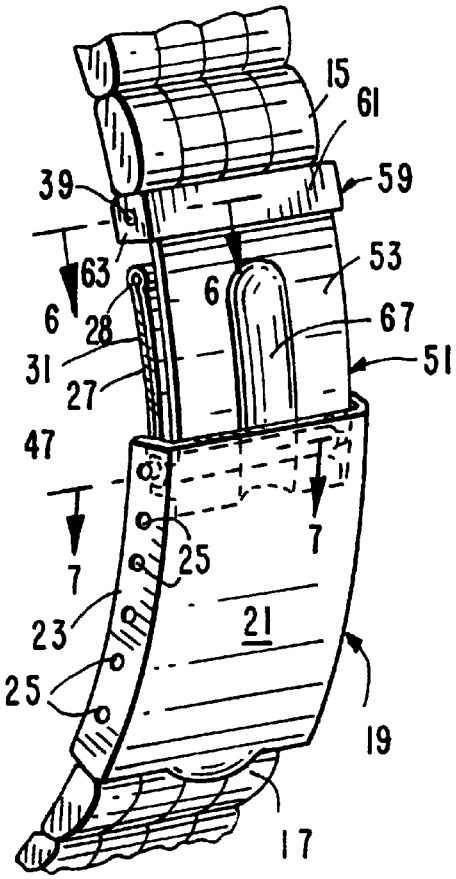
FIG. 5 is a perspective view showing the elements depicted in FIG. 4 coupled together.

Turning now to FIGS. 4–7, the preferred embodiment of the extender element of the invention is described and generally indicated at 51. Extender element 51 is used with a watch assembly similar in design to that depicted in FIG. 1, and, as shown in FIGS. 4 and 5, includes bands 15 and 17, a watch case 13 (like FIG. 1) and a two-element closure consisting of elements 27 and 31 pivotally connected to each other by means of a pivot connection 28, as is well known.

Figure 7:
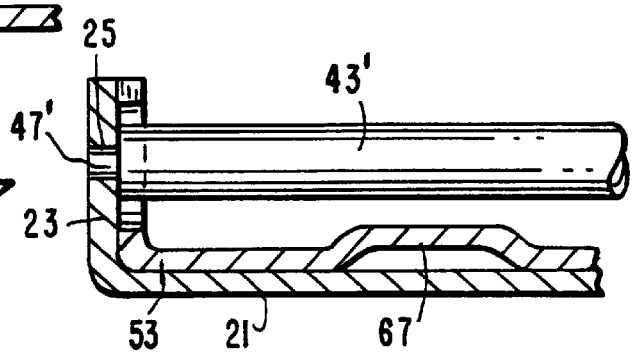
FIG. 7 is cross-sectional view taken along line 7—7 of FIG. 5.

Extender element 51 comprises a body member 53 and a rearwardly disposed coupling member 59. Body member 53 is formed with a longitudinally directed rib 67 for enhancing the structural integrity of extender element 51. Body member 53 includes a pair of transversely directed legs 55, each formed with a cut-out 57. Cut-out 57 is sized to accommodate therethrough a spring-loaded pushpin 43', as best depicted in FIG. 7. Pin 43' includes pin tip elements 47', as previously described, which are selectively received by the desired pair of corresponding holes 25 formed within sidewalls 23 of shell 19 in order to couple body 53 of extender element 51 within shell 19.

Coupling member 59 comprises a top member 61 and a pair of transversely directed legs 63. Each of legs 63 is formed with a hole or opening 65 for receiving pin tip element 39' of pushpin 35' in order to connect coupling member 59 to the end of watchband 15 (see FIG. 6). As with the prior art embodiment described in FIGS. 1–3, the end of watchband 15 includes a tube-shaped tongue 37 which wraps about pushpin 35'.

In accordance with the invention, body 53 of extender element 51 has a first width dimension which is no greater than the inside width dimension between sidewalls 23 of shell 19. On the other hand, coupling member 59 has a second width dimension that is substantially equal to the overall width of shell 19. As a result, each of bands 15 and 17 are able to have substantially the same width, even at the ends thereof, since the end of band 15 is coupled to extender element 29, and the end of band 17 is coupled to shell 19, both of which are of substantially equal width.

Figure 6:
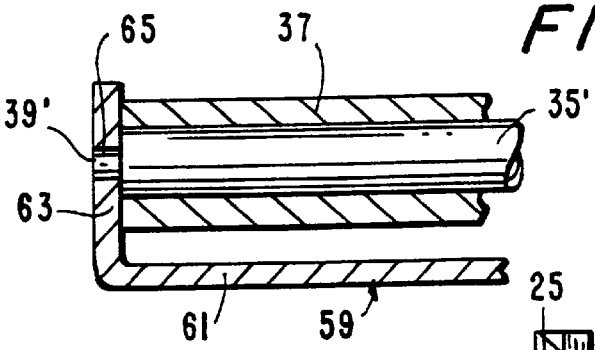
FIG. 6 is a cross-sectional view taken along line 6—6 of FIG. 5.

Moreover, and because pin tip elements 47 of pushpin 43 need only penetrate sidewall 23 of shell 19 (see FIG. 7), a single pushpin design or configuration is required for both coupling extender element 51 to shell 19 (FIG. 7) and the end of watchband 15 to coupling member 59 of extender element 51 (FIG. 6). In other words, both pin members 43' and 35' are interchangeable and are of uniform design.

Figure 9:
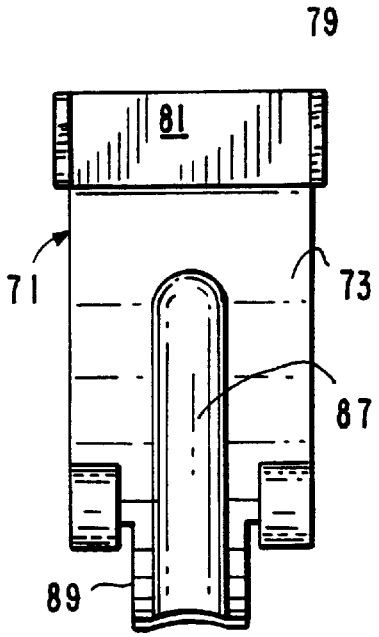
FIG. 9 is a top plan view of the extender element depicted in FIG. 8.
Figure 8:
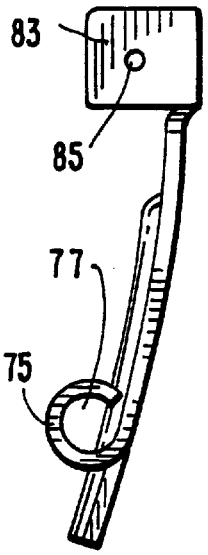
FIG. 8 is a side elevational view of a second version of the extender element of the invention.

Referring now to FIGS. 8–9, a second embodiment of the inventive extender element is described and generally indicated at 71. Extender element 71 comprises a body 73 and a rearwardly depending coupling member 79 of the same design as that depicted in the embodiment of FIGS. 4–7. Body 73 includes a pair of forwardly depending curve-shaped legs 75 which together define a passage 77 for selectively receiving pin 43' therethrough. Body 73 is formed with a forwardly extending shelf 89 projecting beyond from where legs 75 depend. Body 73 is further formed with a longitudinally extending rib 87 as shown.

As with the earlier embodiment, coupling member 79 comprises a top 81 and a pair of transversely depending legs 83, each formed with a hole or opening 85 sized for accommodating therein pin tip elements 39 of pin 35 (see earlier embodiment). As with the first embodiment, coupling member 79 has a width dimension substantially the same as that of the width of shell 19, while body 73 of extender element 71 has a second smaller width that is no greater than the inside width measured between sidewalls 23 of shell 19.

Figure 11:
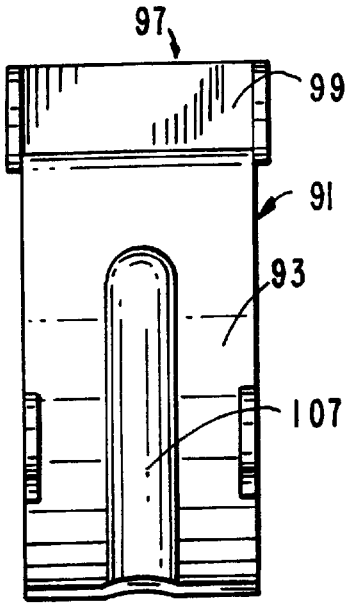
FIG. 11 is a top plan view of the extender element depicted in the FIG. 10.
Figure 10:
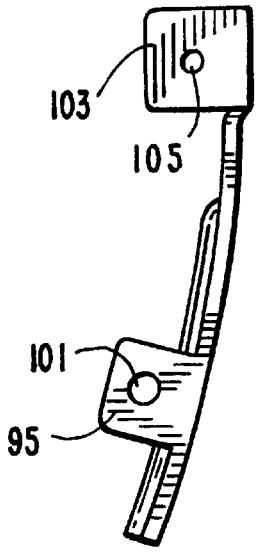
FIG. 10 is a side elevational view of a third version of the extender element of the invention.

Turning now to FIGS. 10–11, the third embodiment of the inventive extender element is described and generally indicated at 91. As before, extender element 91 includes a body 93 and a rearwardly depending coupling member 97. Coupling member 97 comprises a top 99 and side legs 103 formed with holes 105, as described before.

Body 93 has a substantially rectangular configuration and includes a pair of forwardly located legs 95, each formed with holes or openings 101 sized for accommodating pushpin 43 therethrough (see FIG. 6). As with the previous two embodiments, body 91 further includes a longitudinally extending rib 107 for structural integrity. Once again, the width of coupling member 97 is designed to be substantially the same as that of shell 19, while the width of body 93 is somewhat smaller and is no greater than the inside width measured between sidewalls 23 of shell 19.

Figure 13:
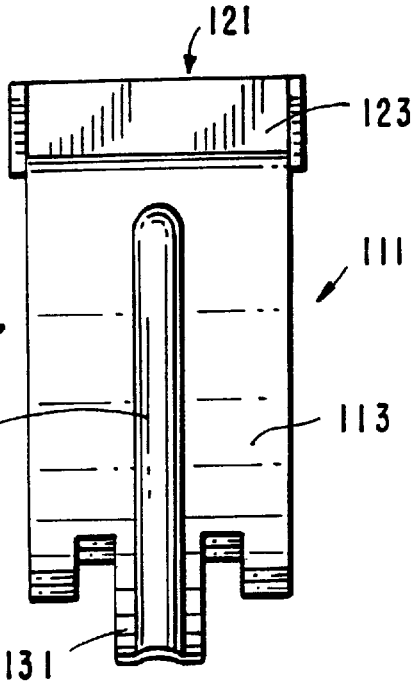
FIG. 13 is a top plan view of the extender element depicted in FIG. 12.
Figure 12:
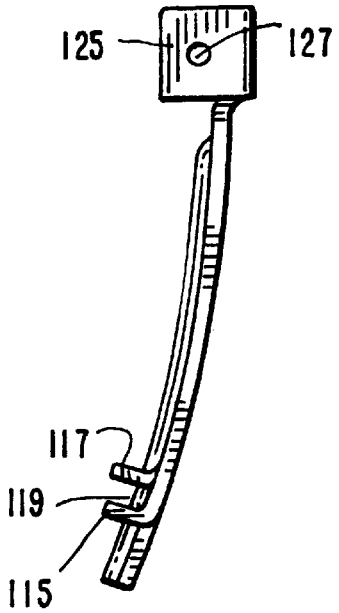
FIG. 12 is a side elevational view of a fourth version of the extender element of the invention.

FIGS. 12–13 illustrate a further embodiment of the inventive extender element. Once again, extender element 111 comprises a body 113 and a rearwardly depending coupling member 121, as shown. Coupling member 121 comprises a top 123 and side legs 125, each formed with a hole 127, as described with respect to the other embodiments.

In this embodiment, body 113 is formed with a pair of forward inwardly depending legs 117 and a pair of forward outwardly depending legs 115, which together define a slot 119 running underneath body 113. Slot 119 is sized for accommodating pushpin 43' (see FIG. 6) therethrough. Body 113 includes a forward depending shelf 131 and is formed with a longitudinally extending rib 129, as described with respect to the other embodiments.

It will thus be seen that the objects set forth above, among those made apparent from the preceding description, are efficiently attained, and, since certain changes may be made in the described product and in the construction set forth, without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

I claim:

1. A watch assembly comprising:

a case and a pair of ends of a watch band of substantially equal and uniform width oppositely depending therefrom;

wherein one of said watchbands is coupled to a shell defining a shell outside wall and having a pair of laterally running sidewalls defining an inside width therebetween, said sidewalls formed with a plurality of pairs of correspondingly aligned holes along substantially the entire length thereof;

a first spring-loaded pushpin selectively receivable between any pairs of corresponding aligned holes at a desired lateral location along said shell and between said walls;

wherein the other of said watchband ends is coupled to an extender element, said extender element comprising an extending body having a width no greater than said sidewalls' inside width, and a member for coupling said extender to the other band at one end thereof having a width substantially equal to said shell width;

wherein said extending body of said extender element comprises a body member having sides and an extending shelf and is formed with a longitudinally extending rib centrally running along said body member and said shelf; said body also including a pair of forwardly located substantially longitudinally aligned legs depending from the sides of said member body for selectively accommodating said pin received between a selected pair of corresponding holes of said plurality of pairs of corresponding aligned holes, such that said extending rib runs continuously longitudinally along said body member and onto said shelf past where said legs depend from the sides of said body member and said extending body of said extender element is sized for selective penetration between the sidewalls of said shell at various lateral locations along substantially the entire length thereof.

2. The assembly of claim 1, further including a pivotal closure member connected between one of said bands and said shell.

3. The assembly of claim 2, wherein said pivotal closure member comprises a first foldable element and a second foldable element.

4. The assembly of claim 3, wherein said foldable elements are pivotally connected to each other so as to be foldable one over the other.

5. The assembly of claim 1, wherein said each of said pair of legs is formed with a cut-out for selectively receiving said pushpin.

6. The assembly of claim 1, wherein said each of said pair of legs includes an opening formed therein through which said pushpin is selectively passed.

7. The assembly of claim 1, wherein said each of said pair of legs has an annular configuration for defining an opening through which said pushpin selectively passes.

8. The assembly of claim 1, wherein said coupling member comprises a pair of sidewalls each formed with an aligned hole.

9. The assembly of claim 8, wherein said holes of said coupling member receive a second spring-loaded pin therebetween for facilitating the coupling of said other of said watchband ends to said coupling member of said extender element.

10. The assembly of claim 9, wherein said other of said watchband ends is formed with a tube-shaped tongue for selectively wrapping about said second spring-loaded pushpin.

11. The assembly of claim 9, wherein each of said first and second pushpins have the same size and design.

12. The assembly of claim 9, wherein each of said pushpins includes a pair or pin tip elements at either end thereof sized for engagement within the holes of said coupling member or shell sidewalls.

* * * * *